US006354961B1

(12) United States Patent
Allen

(10) Patent No.: US 6,354,961 B1
(45) Date of Patent: Mar. 12, 2002

(54) GOLF CLUB FACE FLEXURE CONTROL SYSTEM

(75) Inventor: Dillis V. Allen, Elgin, IL (US)

(73) Assignee: Vardon Golf Company, Inc., Elk Grove Village, IL (US)

( * ) Notice: Subject to any disclaimer, the term of this patent is extended or adjusted under 35 U.S.C. 154(b) by 0 days.

(21) Appl. No.: 09/344,172

(22) Filed: Jun. 24, 1999

(51) Int. Cl.[7] ..... A63B 53/04; A63B 53/06; A63B 53/08

(52) U.S. Cl. ..... 473/329; 473/282; 473/342; 473/345

(58) Field of Search ..... 473/329, 345, 473/346, 290, 291, 332, 327, 326

(56) References Cited

U.S. PATENT DOCUMENTS

| | | | | | |
|---|---|---|---|---|---|
| 5,060,951 | A | * | 10/1991 | Allen | 273/167 |
| 5,176,383 | A | * | 1/1993 | Duclos | 273/167 H |
| 5,401,021 | A | * | 3/1995 | Allen | 273/77 A |
| RE34,925 | E | * | 5/1995 | McKeighen | 273/167 H |
| 5,464,211 | A | * | 11/1995 | Atkins, Sr. | 273/78 |
| 5,873,791 | A | * | 2/1999 | Allen | 473/309 |
| 5,888,148 | A | * | 3/1999 | Allen | 473/290 |

* cited by examiner

*Primary Examiner*—Jeanette Chapman
*Assistant Examiner*—Sneh Varma
(74) *Attorney, Agent, or Firm*—Dillis V. Allen, Esq.

(57) ABSTRACT

A line of golf clubs tailored to the swing speed of the golfer. The basic principles of the present invention can be applied to a single club, but optimally these principles are applied to a plurality of different club heads designed to the specific speed range of the golfer; namely, 50 to 65 mph, 66 to 80 mph, 81 to 95 mph, 96 to 105 mph, and 106 to 140 mph. Maximum ball exit speed from the club head is achieved from club face deflection in each of these ranges near the maximum at which the face wall reaches its permanent elastic deformation. To achieve these principles, the face wall firstly is designed so that the face wall modulus of elasticity increases from a low modulus for the low swing speed range to progressively higher moduli for the higher swing speed ranges. Face modulus can be altered by a variety of a techniques including face wall thinning and face wall reinforcement or a combination of both. In each of the swing speed ranges, the face has a first modulus of elasticity determined by the face itself and after the face deflects to a predetermined value, the face modulus is significantly increased by a stationary power piston that is impacted by the back of the face wall. The power piston impacts the rear of the face wall in each of the clubs within the swing speed range for that specific club. That is, in the low speed, 50 to 60 mph club, the face wall will impact the piston below 65 mph. Where exactly that impact occurs depends upon the design criteria of the club head designer.

4 Claims, 6 Drawing Sheets

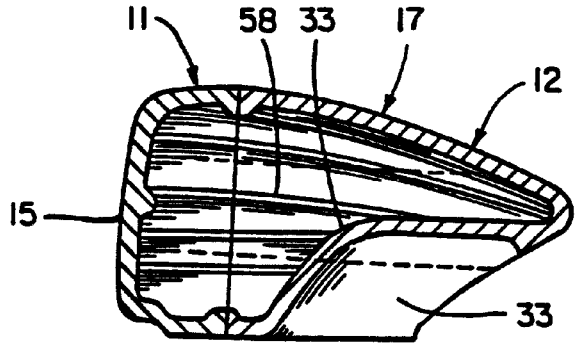
Fig. 8
Fig. 9
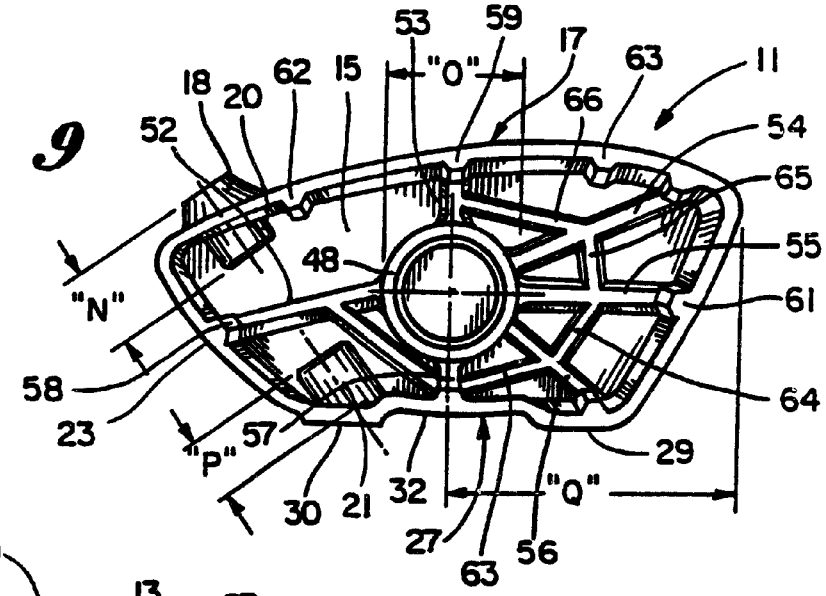
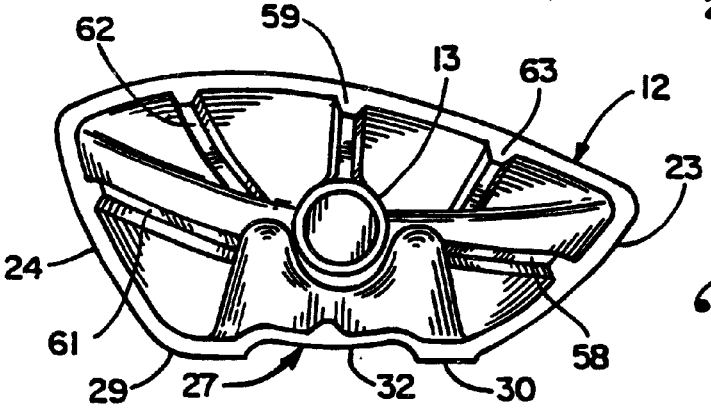
Fig. 10

GOLF CLUB FACE FLEXURE CONTROL SYSTEM

BACKGROUND OF THE INVENTION

The primary objective of the present invention is to design golf clubs for a variety of golfers that optimizes the distance the golfer impels the golf ball. To do this from a physics standpoint, it is necessary to obtain a maximum deflection of the ball striking face, or something approaching that maximum, during the collision with the ball while at the same time maintaining the other parameters of the golf club head within acceptable limits.

This spring-like effect of the ball striking face, which is necessary to achieve maximum distance, has been widely misunderstood in the golf industry, even by many golf club designers. Many golf club designers believe that any deflection of the golf club face during impact with its resulting spring-like effect on the golf ball is a design in violation of the Rules of the USGA. This is a myth because virtually all of the thin walled hollow metal wood clubs have significant face deflection during impact and in fact impart a spring-like effect to the ball as it exits the face. This deflection can be as high as in the range of 0.100 to 0.200 inches. And the USGA has approved such clubs although prior to 1999, it did no ball speed or rebound testing on golf clubs. The USGA has now adopted, although in a state of transition, a ball impact club head test in which the rebound speed of the golf ball is measured and compared against the inbound speed of the golf club impacting the club head sample in a stationary position. If the rebound speed of the ball exceeds a certain percentage of the inbound speed, the club will fail the test and the USGA will notify the submitter that the club head has failed the ball speed test and will not be approved by the USGA.

While it is the primary object of the present invention to maximize the face deflection, without causing face failure, and thus maximize face wall energy imparted to the ball, this does not necessarily mean that club heads made in accordance with the present invention will fail the USGA testing, and club heads designed in accordance with the present invention should be submitted to the USGA for such testing and this application makes no representation as to whether such clubs will or will not pass the USGA testing, particularly bearing in mind that the testing procedures and parameters are presently in a state of flux.

In U.S. Pat. No. 4,461,481, issued to Sunyong P. Kim, entitled "Golf Club of the Driver Type", an internal rod is mounted within the club head extending rearwardly behind the front face and carries a slidable weight 30 that slides back and forth on the rod and impacts the face during ball collision to assist in imparting additional energy to the ball 12. This design is in contravention of the Rules of the USGA because it contains moving parts. It should be noted with respect to the Kim patent, that the present invention contemplates moving parts solely in the sense that the club face deflects and that the USGA has recognized that the club face deflects and that the USGA has recognized that club face deflection by itself does not constitute a moving part nor is it in contravention of past or present USGA Rules.

In my U.S. Pat. No. 5,873,791, entitled "Oversize Metal Wood with Power Tube", issued Feb. 23, 1999, and in my following Continuation-In-Part application, U.S. Pat. No. 5,888,148, entitled "Golf Club Head with Power Shaft and Method of Making", issued Mar. 30, 1999, I describe club head designs in which a power piston is provided to increase the modulus of elasticity of the face wall of the club head throughout the swing speeds in each of the swing speed ranges. The object of the present invention, which is to maximize face deflection, is to reduce the modulus of elasticity in each of the swing speed ranges to achieve maximum face deflection in each of the ranges without causing face failure.

Investment casting techniques innovated in the late 1960s have revolutionized the design, construction and performance of golf club heads up to the present time. Initially only novelty putters and irons were investment cast, and it was only until the early years of the 1980s that investment cast metal woods achieved any degree of commercial success. The initial iron club heads that were investment cast in the very late 1960s and early 1970s innovated the cavity backed club heads made possible by investment casting which enabled the molder and tool designer to form rather severe surface changes in the tooling that were not possible in prior manufacturing techniques for irons which were predominantly at that time forgings. The forging technology was expensive because of the repetition of forging impacts and the necessity for progressive tooling that rendered the forging process considerably more expensive than the investment casting process and that distinction is true today although there have been recent techniques in forging technology to increase the severity of surface contours albeit them at considerable expense.

The investment casting process, sometimes known as the lost wax process, permits the casting of complex shapes found beneficial in golf club technology, because the ceramic material of the mold is formed by dipping a wax master impression repeatedly into a ceramic slurry with drying periods in-between and with a silica coating that permits undercutting and abrupt surface changes almost without limitation since the wax is melted from the interior of the ceramic mold after complete hardening.

This process was adopted in the 1980s to manufacture "wooden" club heads and was found particularly successful because the construction of these heads requires interior undercuts and thin walls because of their stainless steel construction. The metal wood club head, in order to conform to commonly acceptable club head weights on the order of 195 to 210 gms. when constructed of stainless steel, must have extremely thin wall thicknesses on the order of 0.020 to 0.070 inches on the perimeter walls to a maximum of 0.125 inches on the forward wall which is the ball striking surface. This ball striking surface, even utilizing a high strength stainless steel such as 17-4, without reinforcement, must have a thickness of at least 0.125 inches to maintain its structural integrity for the high club head speed player of today who not uncommonly has speeds in the range of 100 to 150 feet per second at ball impact.

Faced with this dilemma of manufacturing a club head of adequate strength while limiting the weight of the club head in a driving metal wood in the range of 195 to 210 gms., designers have found it difficult to increase the perimeter weighting effect of the club head.

In an iron club, perimeter weighting is an easier task because for a given swing weight, iron club heads can be considerably heavier than metal woods because the iron shafts are shorter. So attempts to increase perimeter weighting over the past decade have been more successful in irons than "wooden" club heads. Since the innovation of investment casting in iron technology in the late 1960s, this technique has been utilized to increase the perimeter weighting of the club head or more particularly a redistribution of the weight of the head itself away from the hitting area to the perimeter around the hitting area, usually by providing a perimeter wall extending rearwardly from the face that results in a rear cavity behind the ball striking area. Such a club head configuration has been found over the last two plus decades to enable the average golfer, as well as the professional, to realize a more forgiving hitting area and by that we mean that somewhat off-center hits from the geometric center of the face of the club results in shots substantially the same as those hits on the center of the club. Today it is not uncommon to find a majority of professional golfers playing in any tournament with investment cast perimeter weighted irons confirming the validity of this perimeter weighting technology.

Metal woods by definition are perimeter weighted because in order to achieve the weight limitation of the club head described above with stainless steel materials, it is necessary to construct the walls of the club head very thin which necessarily produces a shell-type construction where the rearwardly extending wall extends from the perimeter of the forward ball striking wall, and this results in an inherently perimeter weighted club, not by design but by a logical requirement.

In the Raymont, U.S. Pat. No. 3,847,399 issued Nov. 12, 1974, assigned to the assignee of the present invention, a system is disclosed for increasing the perimeter weighting effect of a golf club by a pattern of reinforcing elements in the ball striking area that permits the ball striking area to be lighter than normal, enabling the designer to utilize that weight saved on the forward face by adding it to the perimeter wall and thereby enhancing perimeter weighting.

This technique devised by Mr. Raymont was adopted in the late 1980s by many tool designers of investment cast metal woods to increase the strength of the forward face of the metal woods to maintain the requirement for total overall head weight and to redistribute the weight to the relatively thin investment cast perimeter walls permitting these walls to not only have greater structural integrity and provide easier molding and less rejects, but also to enhance the perimeter weighting of these metal woods.

Another problem addressed by the present invention is the achievement of increasing the benefits of perimeter weighting by simply adding weight to the perimeter of the club head itself. This technique, of course, has found considerable success in low impact club heads such as putters, where overall club head weight is in no way critical, and in fact in many low impact clubs that have found considerable commercial success, the club heads weigh many times that of metal wood heads, sometimes three or four times as heavy.

Increased perimeter weighting has been found difficult because of the weight and impact strength requirements in metal woods. An understanding of perimeter weighting must necessarily include a discussion of the parameter radius of gyration. The radius of gyration in a golf club head is defined as the radius from the geometric or ball striking axis of the club along the club face to points of club head mass under consideration. Thus, in effect the radius of gyration is the moment arm or torquing arm for a given mass under consideration about the ball striking point. The total moments acting on the ball during impact is defined as the sum of the individual masses multiplied by their moment arms or "radii of gyration". And this sum of the moments can be increased then by either increasing the length of the individual moment arms or by increasing the mass or face acting at that moment arm or combinations of the two.

Since it is not practical, except for the techniques discussed in the above Raymont and Allen patents, to add weight to the perimeter wall because of the weight limitations of metal woods and particularly the driving woods, one alternative is to increase the moment arm or radius of gyration. This explains the popularity of today's "jumbo" woods although many of such woods do not have enlarged faces because of the requirement for structural integrity in the front face.

In the Allen, U.S. Pat. No. 5,397,126, an improved metal wood golf club is provided having an enlarged or "jumbo" metal club head with a crowned top wall extending rearwardly from a ball striking face wall, a toe wall, and a heel wall also projecting rearwardly from the face wall ———but the club head has no conventional sole plate.

The toe wall and the heel wall are enclosed by the top wall and a pair of spaced generally vertical weighting walls integral with and extending rearwardly from the face wall. The two areas enclosed by the top wall, heel and toe walls, and weight walls are hollow to achieve the desired head weight and the area between the walls is opened, and the weight of the sole plate that normally encloses that area is redistributed to the weight wall to achieve true heel and toe weighting.

Prior attempts to manufacture very large stainless steel metal club heads with larger than normal faces has proved exceedingly difficult because of the 195 to 210 gm. weight requirements for driving club heads to achieve the most desirable club swing weights. Thus, to the present date stainless steel "jumbo" club heads have been manufactured with standard sized face walls, deeply descending top walls from the front to the rear of the club head, and angular faceted sole plates all designed to decrease the gross enclosed volume of the head but which do not detract from the apparent, not actual, volumetric size of the head. This has led to several manufacturers switching from stainless steel to aluminum and titanium alloys, which are of course lighter, to enlarge the head as well as the face.

It has also been suggested in the past that various rods and shafts be cast or attached into the club head for the purpose of rigidifying the forward face wall. However, to the present date, such designs have not achieved any significant commercial success.

The first problem is that, while some of the prior art suggests casting the rods with the forward face, as a practical matter this has never been achieved because of the extreme difficulty in removing the core pieces around the shaft due to interference with the walls of the club head.

A second problem that is not addressed in this prior art is that in order to be effective in reinforcing the front face, the rods need to be integrated into the club head. The rod must also have a weight in the range of 20 to 30 gms. If one simply adds 20 to 30 gram element to a 200 gm. head, the resulting weight of 220 to 230 gms. is excessive and will result in a swing weight far higher than acceptable to the present day average golfer.

An additional problem in many of these prior rigidifying elements is that they are constructed of a low modulus material such as plastic or graphite compositions. These materials do not significantly increase the resonant frequency or the rebound of the face wall. Ideally, the rebound of the face wall; that is, the return of the face wall to its relaxed configuration, should occur at approximately the time the ball exits the face wall. In this way the rebound of the face wall assists in propelling the ball from the club face. If rebound occurs after the ball exits the face wall, the benefits of this effect are completely lost. None of the prior art dealing with these reinforcing elements suggests utilizing this technique for matching face wall rebound with ball exit from the face wall.

A further problem in the prior art references which suggest utilizing these rigidifying elements, is that they are completely silent on how these reinforcing elements, when not cast into the face wall, are attached into the club head. And the method of attachment, as will be seen from the present invention, is critical to the benefits of increasing resonant frequency and rebound of the face wall in accordance with the present invention. Presently known bonding techniques are not sufficient to yield these benefits.

Still another of these prior references suggests making the head of synthetic material and the support rod of a similar material, but these low modulus and soft materials cannot significantly raise the resonant frequency or rebound time of the ball striking face wall.

The following patents or specifications disclose club heads containing face reinforcing elements:

FOREIGN PATENTS:

British Patent Specification, No. 398,643, to Squire, issued Sep. 21, 1933

UNITED STATES PATENTS:

Clark, U.S. Pat. No. 769,939, issued Sep. 13, 1904

Palmer, U.S. Pat. No. 1,167,106, issued Jan. 4, 1916

Barnes, U.S. Pat. No. 1,546,612, issued Jul. 21, 1925

Drevitson, U.S. Pat. No. 1,678,637, issued Jul. 31, 1928

Weiskoff, U.S. Pat. No. 1,907,134, issued May. 2, 1933

Schaffer, U.S. Pat. No. 2,460,435, issued Feb. 1, 1949

Chancellor, U.S. Pat. No. 3,589,731, issued Jun. 29, 1971

Glover, U.S. Pat. No. 3,692,306, issued Sep. 19, 1972

Zebelean, U.S. Pat. No. 4,214,754, issued Jul. 29, 1980

Yamada, U.S. Pat. No. 4,535,990, issued Aug. 20, 1985

Chen, et al., U.S. Pat. No. 4,681,321, issued Jul. 21, 1987

Kobayashi, U.S. Pat. No. 4,732,389, issued Mar. 22, 1988

Shearer, U.S. Pat. No. 4,944,515, issued Jul. 31, 1990

Shiotani, et al., U.S. Pat. No. 4,988,104, issued Jan. 29, 1991

Duclos, U.S. Pat. No. 5,176,383, issued Jan. 5, 1993

Atkins, U.S. Pat. No. 5,464,211, issued Nov. 7, 1995

Rigal, et al., U.S. Pat. No. 5,547,427, issued Aug. 20, 1996

In the Squire British Specification 398,643, the reinforcing rods 10 and 18 are primarily for the purpose of reducing ringing in the face. Squire makes no attempt to maintain head weight within acceptable limits and is completely silent on how the rod 10 can be cast inside the head while removing the core pieces therefrom. Squire is also silent on the rebound or resonant frequency on the head.

The Clark, U.S. Pat. No. 769,939, shows a movable rod that assists in propelling the ball from the club face.

The Palmer, U.S. Pat. No. 1,167,106 shows a weighting element that does not extend completely through the club head.

The Barnes, U.S. Pat. No. 1,546,612, shows rods 13 and 14 extending into the club head, but these rods are for attachment purposes of the face 10 and the club is not a perimeter weighted club.

The Drevitson, U.S. Pat. No. 1,678,637, shows reinforcing partitions 55, but these are not concentrated directly behind the ball striking area, and thus, while rigidifying the face, do not concentrate mass transfer directly to the ball.

The Weiskoff, U.S. Pat. No. 1,907,134, shows a reinforcing member near the center of the club face, but such is not concentrated specifically in the ball striking area and is not a high modulus material.

The Schaffer, U.S. Pat. No. 2,460,435, shows a labyrinth of webs molded in the club head, but the club head is not a high modulus material, nor is the club face and the core 11 is aluminum and not constructed of the same material as the club head.

The Chancellor, U.S. Pat. No. 3,589,731, shows a movable weight between the back and the front of the club that allegedly corrects hooking and slicing.

The Glover, U.S. Pat. No. 3,692,306, shows a weight port integral with the club face in FIG. 6, but Glover's club head is a low modulus resin and is not perimeter weighted.

The Zebelean, U.S. Pat. No. 4,214,754, shows support members 32 in FIG. 10, but they are not connected to the face nor are they concentrated behind the sweet spot.

The Yamada, U.S. Pat. No. 4,535,990, shows a shaft between the rear of the face wall and a back portion of the club, but the Yamada club head is not a high modulus material, and the patent is silent as to how the reinforcement member 31 is connected into the club head cavity.

The Chen, et al., U.S. Pat. No. 4,681,321, shows webs 31 molded inside the club head, but both the club head and the webs are low modulus materials.

The Kobayashi, U.S. Pat. No. 4,732,389, shows a brass plate and a rod that engage the rear of the ball striking face, but the patent is silent as to how it is attached to the face and the club head is solid wood and not a perimeter weighted club head.

The Shearer, U.S. Pat. No. 4,944,515, shows a shaft 24 either cast or attached inside the club head. The Sheer patent is silent as to how the shaft could be cast in the club head and in the alternative suggests that it be fixed in after the club head is made, the patent is silent as to how it might be fixed inside.

The Shiotani, et al., U.S. Pat. No. 4,988,104, shows an insert 15 that is insert molded inside the golf club head, but the club head is a resin type low modulus material, and there is no specific attachment of the insert into the head other than that which results from the insert molding process.

The Duclos, U.S. Pat. No. 5,176,383, discloses a low modulus graphite head having a rod formed on the rear of the ball striking face. The low modulus head provides the Duclos club with minimal perimeter weighting.

The Atkins, U.S. Pat. No. 5,464,211, shows a plate 30 that is threaded from the rear of the club against the forward face which he refers to as a "jack screw". The plate 30 is epoxied to the rear of the face wall and such a design will fail under the extreme high impact loadings of a 150 ft./sec. impact with a golf ball.

The Rigal, et al., U.S. Pat. No. 5,547,427, shows partitions. In the FIG. 9 embodiment, the rod 74 is placed in tension which detracts from rigidifying the front face. In the FIG. 10 embodiment, the rod 23 is not integral with the front face.

A further principle problem addressed in the present invention has resulted from the use of light-weight alloys to produce "jumbo" or oversized metal woods that are particularly popular in today's golfing market. These use light-weight metals such as high titanium alloys that permit the club head to be made larger, providing increased perimeter weighting and an easier to hit larger sweet spot. However, there is a trade-off to this large sweet spot and that is a diminution in ball distance travel or in short, the ball does not travel as far as it does with smaller stainless steel heads, which concentrate more mass behind the ball. This in part explains why professionals on the regular tour rarely use very large titanium club heads.

This diminution in ball distance in jumbo titanium alloys, or other light-weight alloy heads, is believed caused by three factors. First, the very large club heads spread the perimeter wall support points from the ball striking area, causing the face to flex more than smaller heads resulting in a badly delayed rebound of the face. If one can imagine a flat horizontal 1"×6" pine board supported at points two feet apart and a similar board supported at points 10 feet apart, both with a 200 lb. weight in the middle of the boards, the second board will bend substantially more. This oversimplified is what causes in part the greater face flexure in the jumbo metal woods. Secondly, while titanium is a hard material, it has a modulus of elasticity less than half that of ferrous alloys. The lower the modulus, the greater the strain or deflections, for a given load. It should also be noted that today's high titanium alloy jumbo metal wood heads with volumes in the range of 250 to 300 cm.$^3$, have relatively thin wall thicknesses, less than 0.125, and in some cases substantially less than 0.125 inches, which exacerbates the problem of face flexure and slow face rebound.

These three factors all contribute to an incomplete face recovery during ball impact. That is, the club face bends inwardly at ball impact to a state of tension and then returns at some point in time to its normal relaxed position. The rebound of the club face, or its return to its relaxed position, should ideally assist in propelling the ball from the club face. In these prior high titanium jumbo club heads however, the face wall does not fully recover until after the ball leaves the club face, thereby dissipating as waste a portion of the club head energy.

In my application, U.S. Ser. No. 08/859,282, Filed: May 19, 1997, now U.S. Pat. No. 5,873,791, a high modulus golf club head of the "wood" type is provided with a power shaft, a rod for increasing the resonant frequency and decreasing the rebound time of the face, integral at its forward end with the ball striking wall behind the sweet spot and integral with a rear portion of the club head at its rear end. While others have attempted supports for other purposes such as face reinforcement and club sound or feel, they have not been successful because these clubs are either not possible to manufacture, or will fail under the rigors of a 100 to 150 ft./sec. impact velocity against a golf ball.

In that application a jumbo club head in the range of 250 to 300 cm.$^3$ is disclosed constructed of a hard, light-weight alloy such as titanium or beryllium, with an integral power-shaft extending from behind the club face sweet spot to a rear portion of the club head.

The power shaft according to that application was constructed of a metal alloy substantially similar to the metal alloy of the club head so it can be welded or fixed integrally to the sweet spot on the rear of the face wall and cast, welded or fixed integrally to a rear portion of the club head at its rear end. While welding similar metals is certainly not a new concept, it is difficult to weld, for example, a 0.625 inch diameter shaft with a 0.035 to 0.049 inch wall thickness directly to the club head face wall and rear wall because the face wall and rear wall, because of their large areas, require higher heating and welding temperatures resulting in heat distortion of the face wall and rear club head.

To obviate this problem, that application discloses a face wall sweet spot and the rear club head portion with cast in annular retainer walls to which the power shaft is welded. These retainers buff the heat sink effect of the face wall and club head portion and minimize heat distortion in these surfaces during welding.

The power shaft according to that invention is a compromise between club head designs to enhance perimeter weighting and increase the sweet spot area, and the ball distance producing designs that concentrate more mass directly behind the ball at impact.

Hence, I disclose in U.S. Ser. No. 08/859,282, a compromise between increased radius of gyration and increased ball distance.

Another important aspect of my U.S. Pat. No. 5,888,148, and my U.S. Pat. No. 5,873,791, is the customizing of the golf club to the swing speed of the golfer. Golfers swing speed differ radically from about 88 ft/sec. up to as much as 180/ft/sec.(123 mph). The club face at impact becomes concave and before or after the ball leaves the face, the face rebounds to its natural shape. The time the ball remains on the face is surprisingly about the same for the slow swings and the fast, but the harder swinger will compress the ball further. Ideally, for both the fast and slow swinger, the face will rebound precisely as the ball is exiting the face to enhance ball exit velocity. But to do this, bearing in mind time of impact, about 5–7 milli/sec., is about the same for all swing speeds, the face must recover at a faster rate for the high speed swing because it has a greater face deflection. To achieve this, the line of woods gives the higher speed swinger a progressively higher face wall resonant frequency than the lower speed swing. Numerous studies have been made analoging the natural or resonant frequencies of bodies to the rebound of the bodies after bending or deformation and those have been adopted here. But it should be noted however, the natural frequency of all linear structures increases with increasing stiffness and decreases with increasing mass.

In a free body system, the natural frequency of the system f is equal to $$\frac{1}{2\pi}\frac{(K)^{1/2}}{M}$$

where f is in cycle per unit of time, of a beam pinned at both ends and center loaded, as the face of a golf club, the spring constant K; i.e., force/unit deflection at point of L and is equal to $$\frac{3EI}{L^3}$$

when E is the modulus of elasticity of the material, I is the moment of inertia, and L is the unsupported length.

While titanium is a very hard material, it has a relatively low modulus(E) of 16.8 psi×$10^{0.6}$ compared to stainless steel, which is 30 psi×$10^{0.6}$. And the natural frequency varies as $\sqrt{E}$ when E is the modulus of elasticity.

Hence, it is when equating the rebound of a titanium face to that of steel the titanium face must be stiffened significantly more and in quantified amounts, and the present invention provides the tools to do that.

As noted above while golfer swing speeds differ greatly, time of ball impact does not and total club head weight stays in the range of 195 to 205 grams for most all swing speeds. Thus to achieve face frequency matching to swing speed, my U.S. Pat. No. 5,873,791, provided a means to vary face stiffness while maintaining about the same overall head weight.

Toward this end the face wall was stiffened in my U.S. Pat. No. 5,873,791, by selecting a power shaft of varying wall thickness, which of course are of different weight, to equate the weights, the rods are provided with transverse weight ports for high density weights, that yield the same overall weight to the club head but varying stiffness and natural frequency to the club face. In this way, faster face rebound is provided for the higher speed golfer and hence slower face rebound for the slower speed golfer to assure that face rebound coincides with ball exit event on the club face.

Using these philosophies, a line of relatively high modulus metal woods was developed, and while stainless steel can be used, the choice is lighter weight alloys having a high surface hardness such as a high titanium or a high beryllium alloy. Utilizing a single club head body tool(the club head bodies are the same initially as are their face walls), the system includes a plurality of interchangeable power shafts providing increasing stiffness and resonant frequency to the ball striking wall, beginning with thin walled shaft for the slower swinger and progressing to a heavy wall shaft for maximum stiffness and higher resonant frequency for the higher swing speed club.

In accordance with my U.S. Pat. No. 5,888,148, a golf club head with a power shaft is provided with an increased modulus of elasticity by preloading the power shaft, and a method of making a golf club head with and without preload is disclosed wherein the club head is cast or formed in forward and rear pieces along a generally vertical parting line, and the two pieces are assembled in clamshell fashion over the power shaft and thereafter the forward and rear pieces are joined by welding or otherwise bonding while the power tube is held in place. In a high volume club head embodiment, above 250 $cm.^3$, constructed of a low modulus alloy compared to stainless steel, the power shaft has a preload, or static compression, to increase the modulus of elasticity of the head and ball striking face. This preloading technique is expanded in another embodiment into a semi-customized line of golf club woods, where the club head modulus of elasticity increases with the golfer's club head speed by progressively increasing preload in the club head line. The power shaft is press fitted into the rear of the ball striking face to reduce bonding and welding difficulties in joining the power shaft to the ball striking face. The modulus of the face wall and the power shaft is enhanced by casting or welding the sole plate of the club head along an axial extent directly to the outer surface of the power shaft thereby increasing its columnar strength. By applying opposite axial clamping forces to the two club head pieces during and after welding or other heat bonding, the power shaft is preloaded into a static compression state. When the forward and rear pieces are joined by welding, the axial force application is maintained for a predetermined time after welding and assures that weld relaxation and wall relaxation will not significantly reduce the power shaft preload.

Toward these ends, the club head assembly, in one embodiment of my U.S. Pat. No. 5,888,148, represents a deviation and improvement from the golf club head disclosed and claimed in U.S. Pat. No. 5,873,791. In that patent, the difficulties in joining the power shaft to the club head have been significantly reduced by a non-invasive joining method. That is, the power shaft is joined to one or both of the club head forward and rear pieces without requiring entry into the club head cavity with a welding tool or other joining instrument. This is accomplished by the provision of a tapered socket and cooperating tapered projection on the power shaft that when forced together under high pressure, the press-fitted tapers create a joint far superior to other bonding techniques, such as epoxy, and one that eliminates heat distortion and other problems associated with the welding of the power shaft.

The power shaft may be cast with one of the forward and rear pieces, but preferably it is initially formed separately therefrom. As a manufacturing expedient, it is preferred to form the power shaft as a separate molding or forging because it is difficult to control the power shaft dimensional integrity when cast integrally with either the forward or rear piece.

The sole plate has a concave spheroidal central portion that extends upwardly toward the power shaft. The sole plate has edges that are welded or integrally cast with axial portions of the sides of the power shaft. This design significantly increases the columnar modulus of elasticity of the power shaft without increasing weight because it uses the sole plate as a support, and in effect the power shaft forms a part of the sole plate to further increase the strength of the sole plate itself. This is also a significant weight saving technique. Firstly, because the power shaft forms part of the sole plate, sole plate weight is reduced, and secondly, the power shaft modulus is increased without any increase in weight in the power shaft.

Another aspect of my U.S. Pat. No. 5,888,148, is the incorporation of the power shaft preloading technique into an entire line of "wood" type club heads. In this embodiment, variable modulus of elasticity of the club head face wall is achieved, not by providing variable power shaft wall thickness, as in my application, U.S. Ser. No. 859,282, but rather by varying the magnitude of the static preload of the power shaft acting on the rear face of the club head ball striking wall. Preload variation is carried through a semi-customized line of drivers(or fairway woods) including, for example, four differently preloaded drivers. The first driver is designed for the very low swing speed golfer, the fourth for the highest swing speed golfer. With this technique, the first driver has a power shaft preload of about 20 kg., and the fourth has a preload of about 100 kg. The second and third drivers in the line have proportionately intermediate preloads for the intermediate swing speeds.

In short, a high swing speed golfer plays with the highest preload club head, and the lower swing speed golfer plays with a progressively lower preloads depending upon their individual swing speeds.

It is a primary object of the present invention to reduce face modulus to provide maximum face flexure.

SUMMARY OF THE PRESENT INVENTION

In accordance with the present invention, a line of golf clubs is provided tailored to the swing speed of the golfer.

The present invention includes this power piston that significantly raises the ball striking face wall modulus of elasticity somewhere in the speed range of each of the five ranges. By raising the face wall modulus as the face deflects in each of the ranges, the elastic limit of the face is never exceeded even if the club head is swung at a significantly higher speed than the maximum speed within the range. This significant increase in face wall modulus within the range also increases the energy transferred to the ball and ball exit velocity.

In the specific embodiments disclosed in this application, each club in the line has an increasing face thickness with similar reinforcing ribs from the low swing speed club to the highest swing speed club. A socket in the rear of the face wall receives a piston extending forwardly from the rear of the club that is slidable in the socket that impacts the bottom of the socket, and hence, the rear of the face wall as the face wall compresses at ball impact. The timing of ball impact is critical to club head design. For example, in the club head in the 96 to 105 mph range, the axial displacement or spacing of the piston face with the club head relaxed from the socket bottom wall(face wall) can theoretically be selected to impact at a 96 mph impact, and a 105 mph impact, or anywhere in-between. Impact below 96 mph will raise face modulus of elasticity and face flexure throughout the speed range, and thus, denigrate from the objective of the present invention, which is to maximize face deflection without causing face failure. Hence, to optimize face flexure throughout the range, piston impact should occur at or somewhat below 105 mph. Thus, in the 50 to 65 mph range, face impact should occur at or somewhat below 65 mph, and in the 66 to 80 mph range, face impact should occur at or somewhat below 80 mph, and this should be continued for each of the clubs in the range.

It should also be noted that the principles of the present invention can be applied to a single club, as opposed to a plurality of clubs, each for a specific speed range. For example, if the designer is designing a single club for the 85 to 110 mph range, he could select a piston impact point at 100 to 110 mph. This, of course, would favor the golfers with swing speeds just under the piston impact point club head speed, but nevertheless would benefit most golfers within that swing speed range, so long as the swing speed range was not expanded significantly over 20 to 25 mph.

To understand the design philosophy of the present invention, it is helpful to understand exactly how the club head is designed. Firstly, a fairly large number, approximately 20, club heads are compression tested, each with a different face modulus of elasticity. Each of these faces is deflected to its elastic limit, and the face deflection at that elastic limit is recorded. This testing is done without the piston in position. After these results are tabulated, the pistons are installed in these club heads with the face of the pistons spaced from the bottom of the face wall sockets a distance so that the face wall impacts the piston at a force approximately 85% of the force recorded at the proportional limit for that club head. 85% is selected because the thin club face walls on the present day hollow woods are subject to fatigue failure. However, something greater than 85% may also be appropriate after fatigue testing analysis is completed for the particular club head design in question, and such is within the scope of the present invention.

Then the speed ranges are selected for each club by testing with a mechanical club swinging machine. Face impact with the piston face can be determined by the significant change in impact sound as club head speed increases in the test beyond the piston impact speed.

The inherent result of this design process is to have a minimum face thickness in each speed range reducing club head weight so the additional weight of the power piston does not result in overweight club heads. Also, because this design reduces face weight, the saved weight can be moved to the perimeter walls for improved parameter weighting.

While the impact of the power piston with the front face may impart additional energy to the ball during impact, its primary function is to permit the club face within a substantial portion of each speed range to flex to its maximum value without exceeding the proportional or elastic limit of the face wall. And face failure is a significant problem in the design of metal wood clubs. This applicant has been designing golf clubs using long driving competition, LDA, for many years, and has knowledge that many of the very well known driver clubs fail as often as once a week for these high swing speed players, in excess of 120 mph, and this fact is not known or experienced by the low swing speed player. The philosophy of the present invention is to permit the slow swing speed player, as well as the high swing player, to press the elastic limit of his club face to maximize club head and face wall energy transfer to the ball.

Also, impact of the socket bottom wall and the piston causes the energy stored in the piston to be transferred to the ball as the ball exits the club head. This principle is described in my early U.S. Pat. No. 5,873,791, and its Continuation-In-Part, U.S. Pat. No. 5,888,148, discussed above.

BRIEF DESCRIPTION OF THE DRAWINGS

FIG. 8 is a longitudinal section of the club head illustrated in FIGS. 1 to 7 taken off the center line thereof so that the power piston does not appear therein;

FIG. 9 is a cross section of the club head illustrating the rear of the front face and the front face socket;

FIG. 10 is a cross section of the club head looking rearwardly from the FIG. 9 section showing the power piston extending forwardly therefrom;

DETAILED DESCRIPTION OF THE PREFERRED EMBODIMENTS

The club head 10 illustrated in FIGS. 1 to 10 is preferably constructed of a titanium alloy such as 6AV4, which signifies a high titanium alloy of 6% aluminum, 4% vanadium, and the balance pure titanium. The club head 10 has a volume of 280 cm.$^3$, and ball striking face area of 43.25 cm.$^3$. Aspects of the present invention are applicable to "wood" type club heads having total volumes in the range of 150 to over 300 cm.$^3$, as well as face areas in the range of 25 to 45 cm.$^3$.

Figure 11:
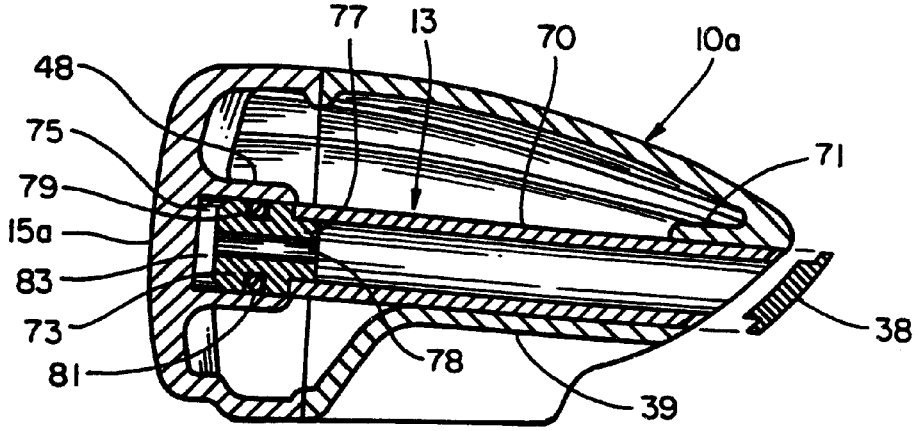
FIGS. 11 to 14 are similar cross sections illustrating the differing face thicknesses and face moduli in the four club heads in the line of club heads.
Figure 15:
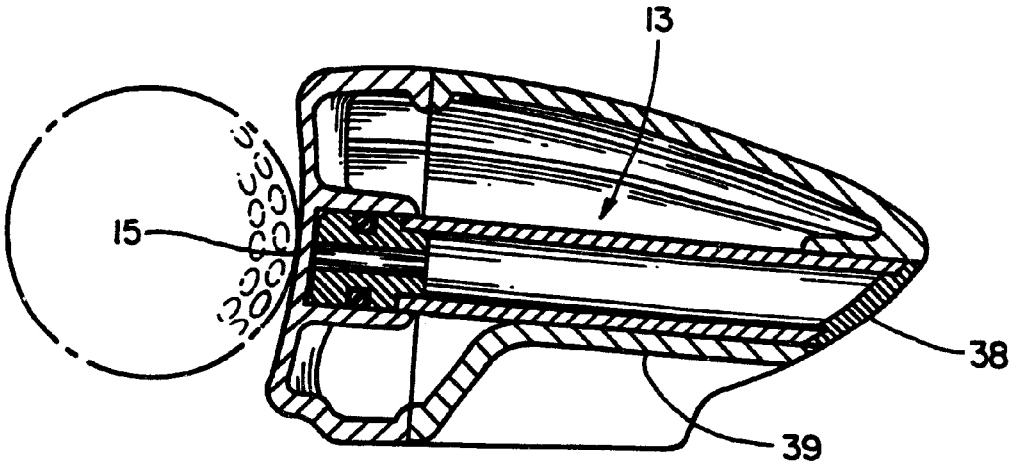
FIG. 15 is a cross section similar to FIGS. 11 to 13 at ball impact with the face wall being pressed and the face wall impacting the front face at the piston.

The club head 10 illustrated in FIGS. 1 to 7 is constructed of three pieces that are joined together in assembly; namely, a club head forward portion 11 illustrated in FIG. 9, a club head rear portion 12 illustrated in FIG. 10, and a power shaft 13 shown in FIGS. 11 and 15. The power shaft 13 is cast or formed separately from the rear portion, attached to the rear portion by welding or press-fitting it therein.

Viewing FIGS. 1 to 10, the club head 10 is seen to generally include a grooved ball striking face wall 15 having an area of about 43.25 cm.$^3$ and a wall thickness as viewed in the plane of FIGS. 1 to 14 that progressively decreases in the club line from FIG. 11 to FIG. 14. In this regard, the wall thicknesses throughout the club head 10 are in the range of 2 to 3 mm. except for the face wall 15, which varies in the line. A crowned top wall 17 extends integrally and rearwardly from the upper portion of the face wall 15, and it has a short integral hosel segment 18 projecting upwardly therefrom with a shaft receiving bore 19 therein that extends through spaced hosel segments 20 and 21 illustrated in FIG. 9.

Figure 1:
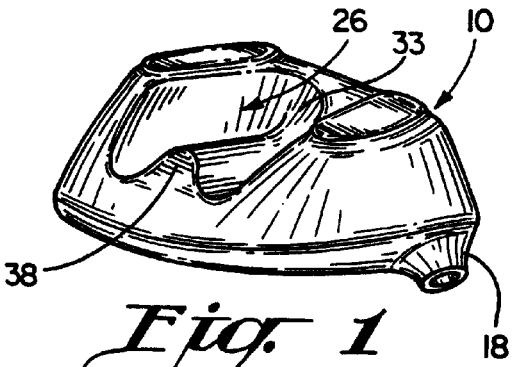
FIG. 1 is a bottom heel perspective of a club head made in accordance with the present invention.

A heel wall 23 is integral with and extends in an arcuate path rearwardly from the right side of the face wall 15 as viewed in FIG. 1. A toe wall 24 is formed integrally with the face wall 15 and extends rearwardly in an arcuate path from the extreme toe end of the face wall 15 and is also integrally formed with the top wall 17, as is the heel wall 23.

Figure 2:
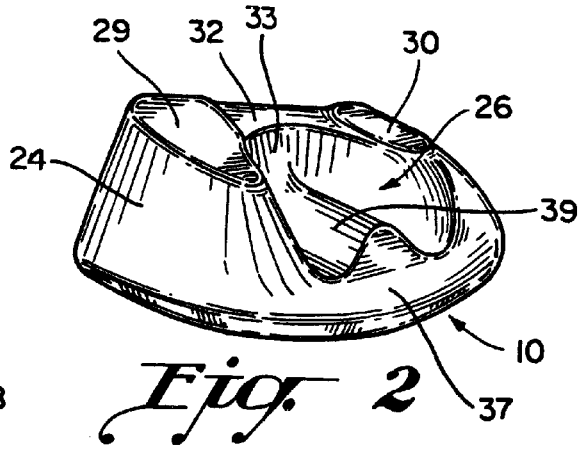
FIG. 2 is a bottom toe perspective of the club head illustrated in FIG. 1.

As seen in FIGS. 1 and 2, there is a cavity 26 formed in the bottom of the club head 10 that conforms to the shape of the rear of the power shaft 13. Cavity 26 is defined by a sole plate 27 that is not a separate piece but formed by the forward and rear portions of the club head sub-assemblies illustrated in FIGS. 9 and 10. Sole plate 27 has a toe rail 29 and a heel rail 30(see FIGS. 1, 2 and 7) that are coplanar as seen when comparing FIGS. 5 and 6 and provide the set-up geometry for the club head; i.e., face angle(open-closed), face loft, club head lie, etc. The forward sole plate portion 32 is recessed upwardly from the plane of the set-up rails 29 and 30 and is arcuate when viewed from the bottom of the club head. Sole plate portion 32 connects with an integral upwardly extending semispheroidal wall 33 that defines the cavity 26 and extends upwardly from the arcuate rear ends 34 and 35(FIG. 6) of the set-up rails 30 and 29 respectively.

As seen in FIG. 8, semi-spheroidal wall 33 is formed entirely in club head rear sub-assembly 12.

The heel wall 23 and the toe wall 24 smoothly connect tangentially with a club head rear wall 37 that has a semi-ellipsoidal segment 38 welded to and enclosing the rear end of the power shaft 13.

As seen in FIG. 11, the upper semi-annular portion 39 of the spheroidal cavity wall 33 runs along a line parallel to the power shaft 13 and is welded to the sides of the power shaft 13 to increase the modulus of elasticity of the power shaft in the columnar or axial direction.

Figure 3:
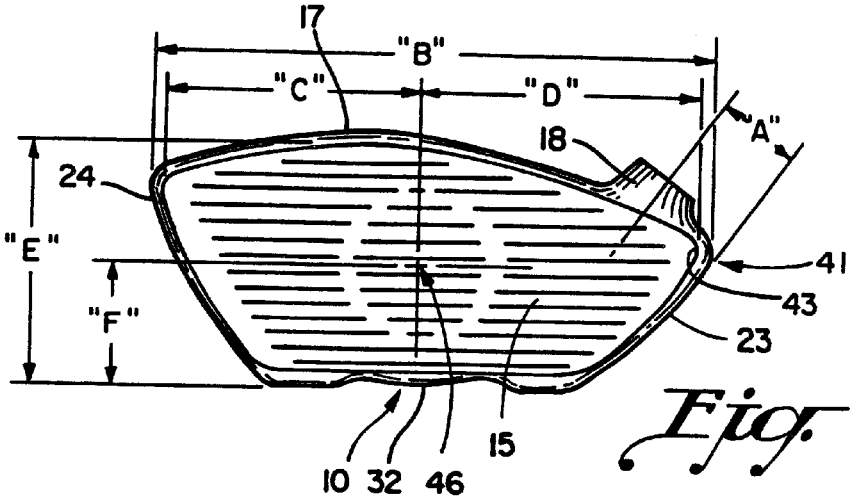
FIG. 3 is an enlarged front view of the club head illustrated in FIGS. 1 and 2.
Figure 4:
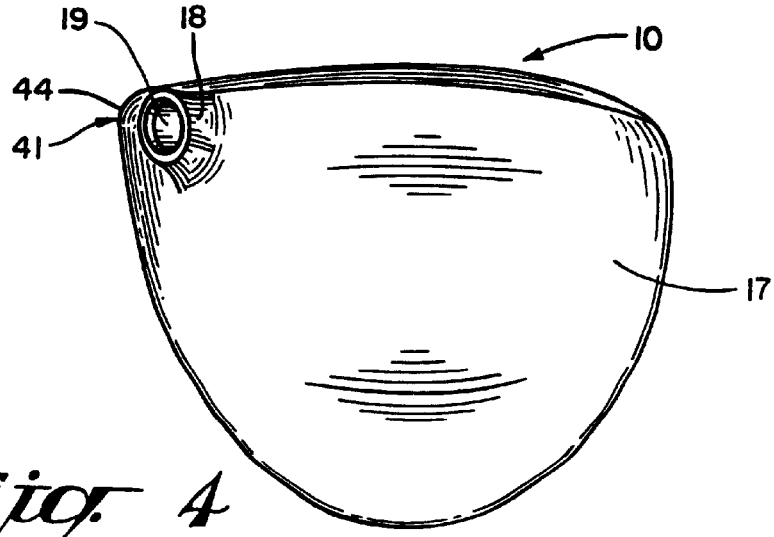
FIG. 4 is a top view of the club head illustrated in FIGS. 1 to 3.

As seen in FIGS. 3 and 4, the club head 10 has a somewhat pointed heel 41 that projects outwardly from the hosel 18 in a direction perpendicular to the axis of the hosel a distance of 15.8 mm. This dimension is taken from the furthest extent of the heel when viewed in the plane of FIG. 3, which is somewhat further from hosel axis 42 than the furthest extent 43 of the face wall 15 because of the radius 44 of the heel wall 23 as seen in FIG. 4. This relationship conforms with the Rules of the USGA.

Viewing FIG. 3, the total heel to toe length of the club head 10, dimension B, is 110 mm., while the total heel to toe length of face wall 15(C+D) in a horizontal direction is somewhat less, about 105 mm. The furthest toe extension on the face wall from a vertical plane containing geometric center 46, dimension C in FIG. 3, is 48 mm., while the furthest extent of the face wall from the heel to the vertical plane of point 46, dimension D, is 57 mm. Maximum face wall height, dimension E, is 48 mm. and geometric point 46 is spaced a distance of 25 mm.(F) from the ground.

Figure 5:
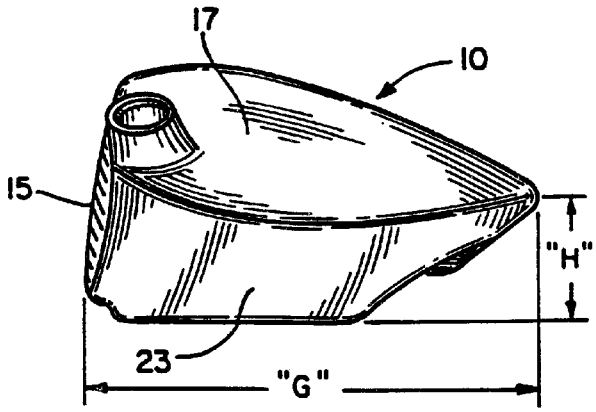
FIG. 5 is a right side view taken from the heel of the club head illustrated in FIGS. 1 to 4.
Figure 6:
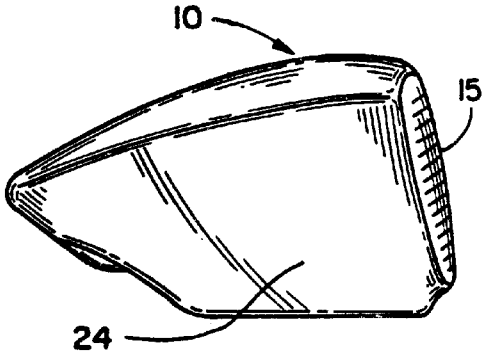
FIG. 6 is a left side toe view of the club head illustrated in FIG. 5.

Viewing FIG. 5, total club head length from the lower leading edge of the club face, dimension G, is 90 mm., while the rear end of the top wall 17, dimension H, is 24 mm. off the ground, and the lower rear end of the power tube 13 is 9.5 mm. off the ground(J in FIG. 8).

Figure 7:
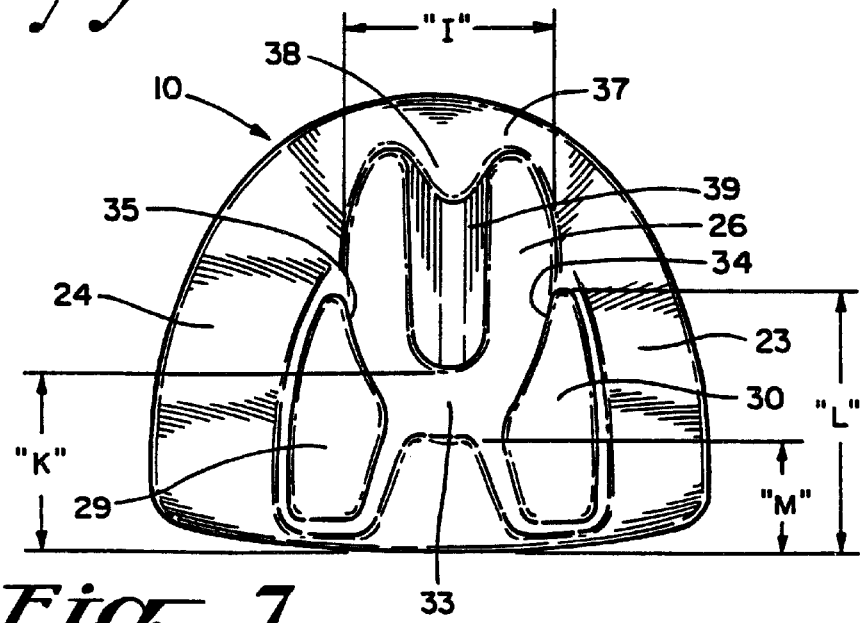
FIG. 7 is a bottom view of the club head illustrated in FIGS. 1 to 6.

Viewing FIG. 7, the forward-most portion of the cavity portion 39, from the lower leading edge of the face wall 15(dimension K) is 36 mm., while the rear end of the set-up rails 29 are spaced a distance L from the lower leading edge of the face wall of 54 mm., and the forward portion of the sole plate portion 32 is spaced 22 mm. from the face wall leading edge identified by the letter M in FIG. 7.

Viewing FIG. 9, upper hosel segment 20 has an axial length N of 14 mm., while lower hosel segment 21 has an axial extent P of 12 mm. Distance Q is the horizontal distance from geometric center 46 to the furthest toe extent of the rear portion casting 17, and that value is 50 mm.

The power shaft 13 has an outer diameter of 13 mm. and a wall thickness of 0.8 mm., although shown somewhat heavier in the drawings.

Viewing FIG. 9, face wall 15 has integral reinforcing ribs 52, 53, 54, 55, 56, 57, and 58 extending outwardly from and integral with an annular socket 48. Ribs 52 and 55 extend generally horizontally while ribs 53 and 57 extend generally vertically. Rib 52 connects with and is integral with rib 58 that is integral with and approximately midway up the heel wall 23. As seen in FIG. 8, rib 58 extends all the way to the rear end of the heel wall 23. Rib 53 connects with and is integral with top wall rib 59 that extends centrally in the top wall 17 and rearwardly to the rear end of the top of the power shaft 13 as seen in FIG. 10.

Face wall rib 55 connects with and is integral with toe wall rib 61 that extends rearwardly and generally centrally in the toe wall 24 to the rear end of the club head, as seen in FIG. 10. The top wall has additional ribs 62 and 63 that also extend to the rear end of the top wall 17.

Connecting ribs 62, 63, 64, 65 and 66 interconnect ribs 52 to 57, 57 to 56, 56 to 55, 55 to 54, and 54 to 53 respectively to provide additional reinforcement for face wall 15.

All of these ribs have a width slightly over 3 mm. and a thickness(their extension from the inner surface of the walls from which they project) of about 2 mm.

As seen in FIG. 8, the parting line between the forward portion 11 and the rear portion 12, which are separate castings, is about 21.5 mm. from the lower leading edge of the face wall 15 in a rearward direction along a vertical plane extending along the target line through point 46.

A socket similar to socket 48 can be provided in the rear of the club head to receive the rear end of the power shaft 13 to eliminate welding the power shaft 13 to the rear end of the club. However, minor heat distortion caused by welding the rear end of the club to the rear wall of the club is not a significant problem.

Figure 12:
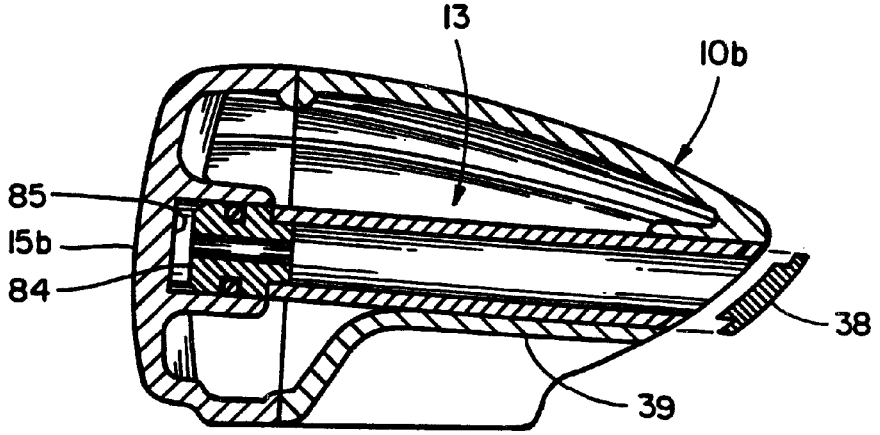
Figure 13:
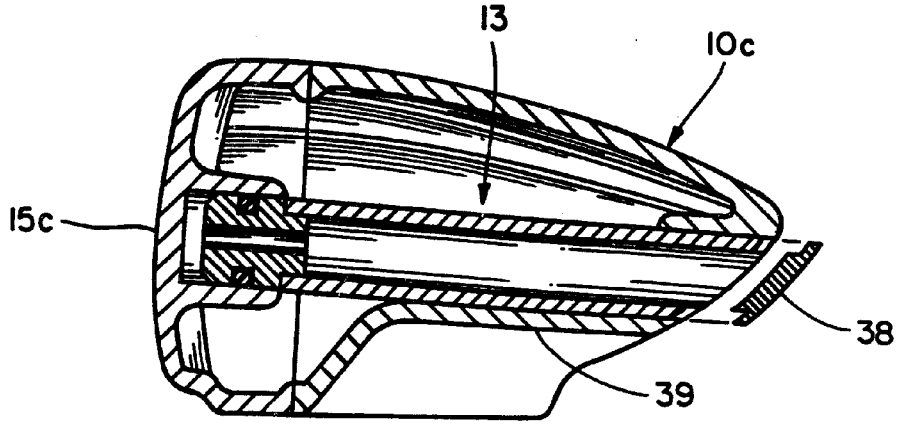
Figure 14:
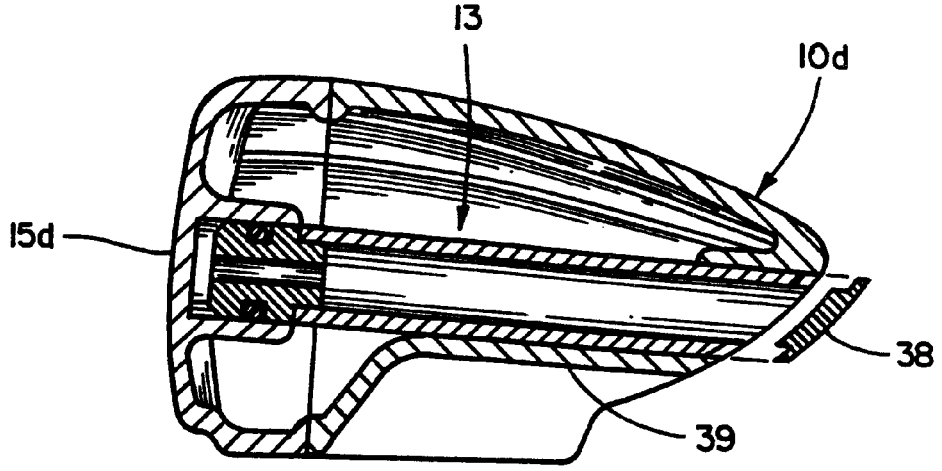

Viewing FIGS. 11, 12, 13 and 14, the four clubs in the present line of clubs are depicted with the highest swing speed club depicted in FIG. 11, and the lowest swing speed club depicted in FIG. 14. As may be seen in these Figures, the face wall 15*a* in the club head 10*a* seen in FIG. 11 has the heaviest face wall, and hence, the highest face wall modulus of elasticity, the face walls 15*b*, 15*c*, and 15*d* are progressively thinner with wall 15*d* having the lowest face wall modulus of elasticity. It should be understood, however, that any number of clubs may constitute a club line according to the present invention, and in fact, in the FIG. 16 Stress Strain Curves, five club heads are illustrated rather than the four shown in FIGS. 11 to 14. Ideally, there should be a greater number of clubs in the line to tailor the line to more golfers. If each club head was designed for a 5 mph swing speed range, there could be 15 or more clubs in the line. However, the number of clubs in the line should really not exceed about eight to minimize customer confusion when selecting the swing speed club for his or her range. For explanation purposes only, the club head 10*d* in FIG. 14 is assumed to be the 50 to 65 mph club head illustrated in FIG.

Figure 16:
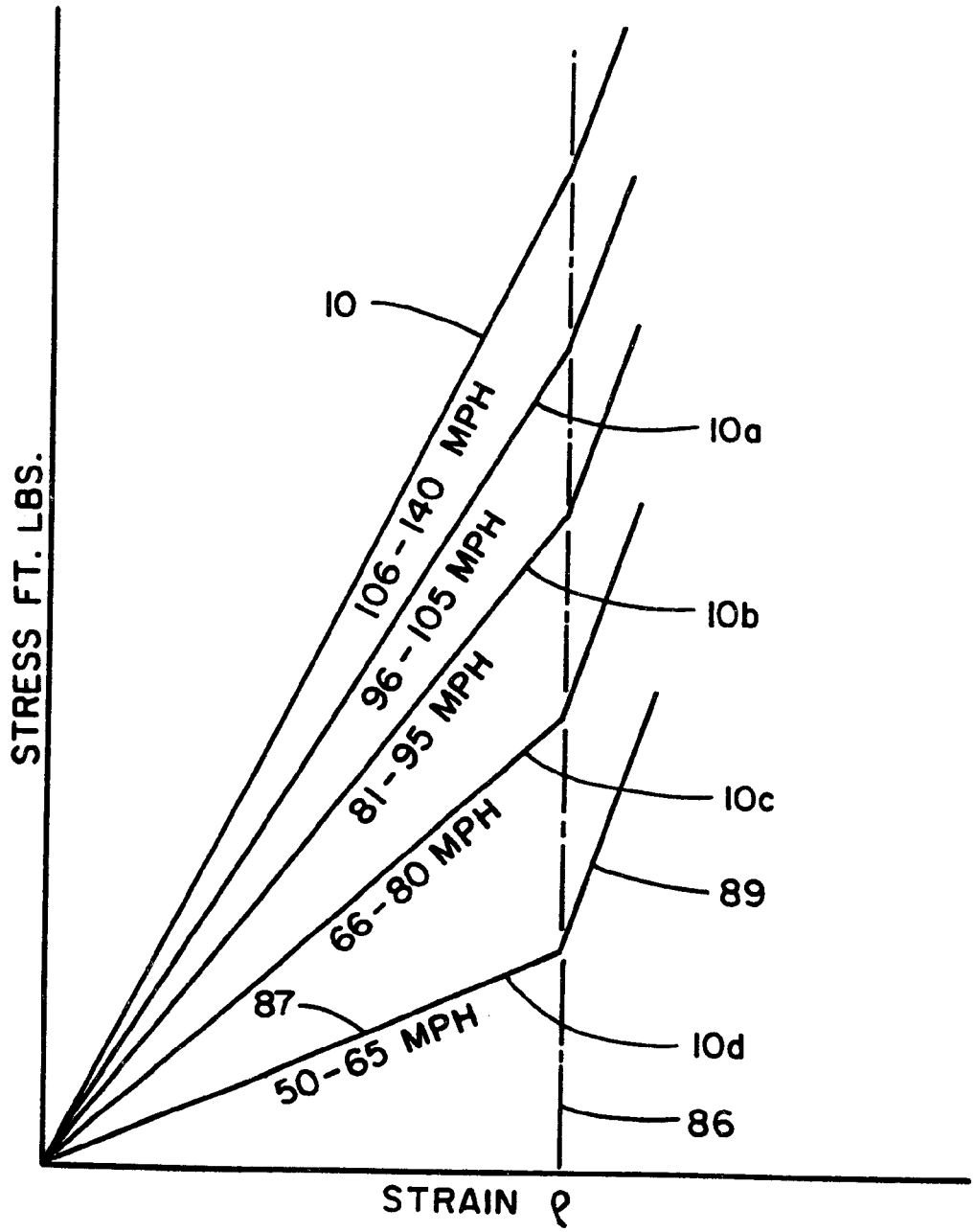
FIG. 16 is a stress strain curve for each of the club heads illustrated in FIGS. 11 to 14.

16; the club head 10*c* illustrated in FIG. 13 will be assumed to be the 66 to 80 mph illustrated in FIG. 16; the club head lob depicted in FIG. 12 will be assumed to be the 81 to 95 club head in FIG. 16; and the club head 10*a* depicted in FIG. 11 will be assumed to be the 96 to 105 mph club head in FIG. 16.

The power tube assembly 13 includes an annular tube, welded to an annular socket 71 formed integrally in the rear of the club head, the closure cap 38, the socket 48, and piston 73 welded to the front end of the tube 70 and slidable in socket bore 75.

The piston 73 has a downwardly stepped rear portion 77 that fits inside tube 70, an annular through bore 78, and a central annular groove 79 that receives a rubber "O" ring 81. The outer diameter of the "O" ring 80 is larger than the outer diameter of the piston 73 to minimize lateral vibration of the piston 73 against the walls of socket bore 83 and reduce the noise level at ball impact. Hole 78 is necessary so that no air is compressed between the forward face of the piston and the socket 75.

The spacing of the piston forward wall 84 from the socket bottom wall 85 is an important aspect of the present invention and is not necessarily, but may be, the same in each of the club heads 10*a*, 10*b*, 10*c*, and 10*d*. In all of the club heads in the line, however, the swing speed at which the rear of the face wall 15 impacts the forward surface of the piston 84 have a specific relation to the swing speed range for which that club head is designed. For example, the low swing speed range club head 10*d*; i.e., 50 to 65 mph, might be designed to have a piston impact at 65 mph. It could, however, be somewhat higher or somewhat lower than 65 mph, and the exact impact speed point should best be determined by club head testing. In any event, whatever the relation of piston impact speed to the club head speed range should be consistent with all of the clubs 10*a*, 10*b*, 10*c*, and 10*d* in the line.

As noted above, the spacing between the forward face 84 of the piston and the bottom wall 85 of the cavity, is shown approximately the same in club head 10*a*, 10*b*, 10*c*, and 10*d*, but in practice the piston spacing or piston clearance may be different in each of the club heads depending upon the moduli of elasticity of face walls 15*a*, 15*b*, 15*c* and 15*d*.

Piston clearance is determined experimentally and is selected so that piston impact occurs at about 85% of the strain at the yield point of the face wall. The yield point, of course, is that point on the Stress Strain Curve whereupon relaxation of the face wall it does not follow the Stress Strain Curve during compression. One method for making this determination is with a variety of face wall thicknesses. For example, ten part 11*s* could be constructed having face wall thicknesses from 0.050 inches to 0.150 inches in 0.010 increments. These part 11*s* are then placed in a compression machine with a plotting stylus, parting line surface downwardly and face wall 15 upwardly. A semihemisphere golf ball is then placed between the upper platen and the club face, arcuate surface against the base, of course, and compression testing is conducted using a dial indicator for measuring face flection from below on the rear of the face wall. The yield point is quite easily determined in a plotting compression testing machine by cycling up and down the stress strain curve with increasing cycle length until the stylus fails to return exactly down the compression line. The maximum deflection at the yield point on the dial indicator is then tabulated for each of the club heads, and since these club heads have reached the yield point, they have been damaged and cannot be used for further testing. Then duplicates of these heads are utilized to make assembled club heads with the clearance space of the piston being 85% of the tabulated yield strains noted in the compression testing. This 15% safety factor is desirable because there is a mild amount of stress repetition fracture in golf club heads, even those that are well made.

After the club heads 10*a* to 10*d* have been assembled, or however many are being tested, with the appropriate piston clearance for each club head, the club heads are tested utilizing a mechanical club swinging device with accurate club head speed measurement capability. The swing speed range for each head is determined by noting the club head swing speed at which piston impact occurs. Piston impact produces a significant change in ball impact sound and is easily noted by the testing crew. For example, club head 10*d* was noted to have piston impact at 65 mph swing speed so that swing speed(or something close to that speed) is assigned to club head 10*d* as the upper limit of its swing speed range. The lower limit for the slowest swing speed in the low swing speed club in the line, of course, is an arbitrary value. obviously, the golfer that swings near the upper end of the range is going to benefit most from this club head line design, and that is why ideally there should be more than four clubs in the line.

In FIG. 16, the strain line 86 represents the strain at 85% of the yield point. As noted above, while the strain is shown equal for all the clubs in FIG. 16, they are not necessarily equal, but may be as a consequence of coincidence. Line 86 thus represents the strain at which the piston impacts the bottom of the socket 85 in each of the club heads. In each of these curves, 10*a*, 10*b*, 10*c*, and 10*d*, the slope of the lower portion of the curve 87 is proportional to the modulus of elasticity of the face wall unsupported by the power piston assembly 13, and the slope of the second portion 89 of the curves represents the modulus of elasticity of the face wall after it impacts the power piston assembly 13 and, of course, in each case is seen to be substantially higher than the slope of portion 87. It should be noted that the slope of the stress strain curves in FIG. 16 is proportional to modulus of elasticity.

As discussed briefly above, the fundamental principles of the present invention can be applied with a lesser benefit to a single club as opposed to a multiple club line. Some manufactures may prefer to utilize these design principles in a single club because they may view the custom clubfitting process as being customer confusing or retailer confusing because it requires measuring the customer's swing speed, usually with an electronic swing speed measuring device. Most average golfers have swing speeds in the range of 60 to 90 mph. If a club manufacturer preferred to make a one club line, the club could be designed so that face wall impact with the front face of the piston would occur at a 90 mph swing speed. This design, of course, would benefit the 85 to 90 mph swing speed the most, with a lesser benefit for those players in the 60 to 85 mph range. And if a player above 90 mph used the club, he would not damage the club because of the increased modulus of elasticity above 90 mph. This benefit is also characteristic of the multiple club line designs described above when using swing speeds above each of the designed ranges.

What is claimed is:

1. A golf club head designed to augment ball exit velocity, comprising: a club head body having a face wall, a generally rearwardly extending perimeter wall about at least a portion of the face wall, the face wall being relatively thin to maximize face deflection and face energy applied to the ball without exceeding the elastic limit of the face, said face thickness being selected so the face has a first low modulus of elasticity in a first lower portion in a lower swing speed range, and means in the club head body including the face wall for providing the face wall with a second higher modulus of elasticity in a second higher swing speed range, said means in the club head for providing the face wall with a second higher modulus of elasticity in a second speed range including a socket formed on the face wall and a shaft extending forwardly from the rear of the club head carrying a piston slidable in the socket, said piston being spaced from a bottom of the socket, the spacing between the piston and the bottom of the socket determining the face displacement at which the modulus of elasticity of the face increases.

2. A golf club head as defined in claim 1, wherein the socket is formed integrally with the face wall, and flexible seal means between the piston and the socket to reduce vibration.

3. A golf club head as defined in claim 2, and means to release air pressure between the piston and socket.

4. A line of golf clubs production customized for golfers' swing speeds, comprising: a plurality of golf club heads having similar shapes and weights, a plurality of shafts connected to the club heads, each of said club heads having a ball striking face wall and a perimeter wall that extends rearwardly from at least a portion of the face wall, said line of clubs being constructed so that modulus of elasticity of the face walls in each of a plurality of discrete swing speed ranges increases as the swing speed ranges increase, said face modulus of elasticity being low in a lower portion of each of the speed ranges to provide increased face wall deflection near the elastic limit of the face wall in each swing speed range, and means to increase the modulus of elasticity in each club in the line in an upper portion of each of the swing speed ranges, said means to increase the modulus of elasticity in each club so the line including a power piston fixed to the rear of the club head and slidable in a socket on the ball striking face.

* * * * *